United States Patent [19]

Krantz et al.

[11] 4,194,906

[45] Mar. 25, 1980

[54] WEAR RESISTANT LOW ALLOY WHITE CAST IRON

[75] Inventors: Tibor Krantz, Pierrefonds; Jean C. Farge, Rosemere, both of Canada

[73] Assignee: Noranda Mines Limited, Ontario, Canada

[21] Appl. No.: 906,620

[22] Filed: May 16, 1978

Related U.S. Application Data

[63] Continuation of Ser. No. 747,105, Dec. 3, 1976, abandoned.

[30] Foreign Application Priority Data

Sep. 13, 1976 [CA] Canada ..... 261107

[51] Int. Cl.[2] ..... C22C 37/10

[52] U.S. Cl. ..... 75/125; 75/123 CB; 148/35

[58] Field of Search ..... 75/123 CB, 125; 148/35, 148/138

[56] References Cited

U.S. PATENT DOCUMENTS

| | | | |
|---|---|---|---|
| 3,623,922 | 11/1971 | Williams et al. | 75/125 |
| 3,695,865 | 10/1972 | Wolker | 75/123 CB |

FOREIGN PATENT DOCUMENTS

| | | | |
|---|---|---|---|
| 786270 | 5/1968 | Canada | 75/125 |
| 1233596 | 5/1971 | United Kingdom | 75/125 |
| 351921 | 10/1969 | U.S.S.R. | 75/123 CB |

OTHER PUBLICATIONS

"Cast Metals Handbook," AFS 1944, pp. 558, 573.

*Primary Examiner*—Arthur J. Steiner
*Attorney, Agent, or Firm*—Fleit & Jacobson

[57] ABSTRACT

A low alloy white cast iron has been developed for wear resistance applications. The alloy consists essentially of about 2 to 4% carbon, 0.3 to 1.5% silicon, 0.5 to 1.5% manganese, 0.5 to 1.5% copper and 0.25 to 1% molybdenum, the remainder being substantially iron except for incidental impurities commonly found in cast iron. The preferred alloy composition is 2.5 to 3% carbon, 0.6 to 0.9% silicon, about 1% manganese, about 1% copper and about 0.5% molybdenum, the rest being substantially iron. The process for manufacturing the above wear resistant alloy consists in melting an alloy having the composition mentioned above, casting such alloy into moulds to produce a desired product such as grinding balls or slugs, shaking the product out of the moulds at a temperature of 750° C. or higher, preferably about 900° C. and cooling the product at a rate of 2° to 15° C./sec., preferably 5° to 10° C./sec. The as-cast product is preferably heat treated at a temperature between 200° and 400° C., preferably about 260° C. for a time of 1 to 8 hours, preferably about 4 hours to increase the hardness thereof.

6 Claims, 1 Drawing Figure

WEAR RESISTANT LOW ALLOY WHITE CAST IRON

Figure 1:
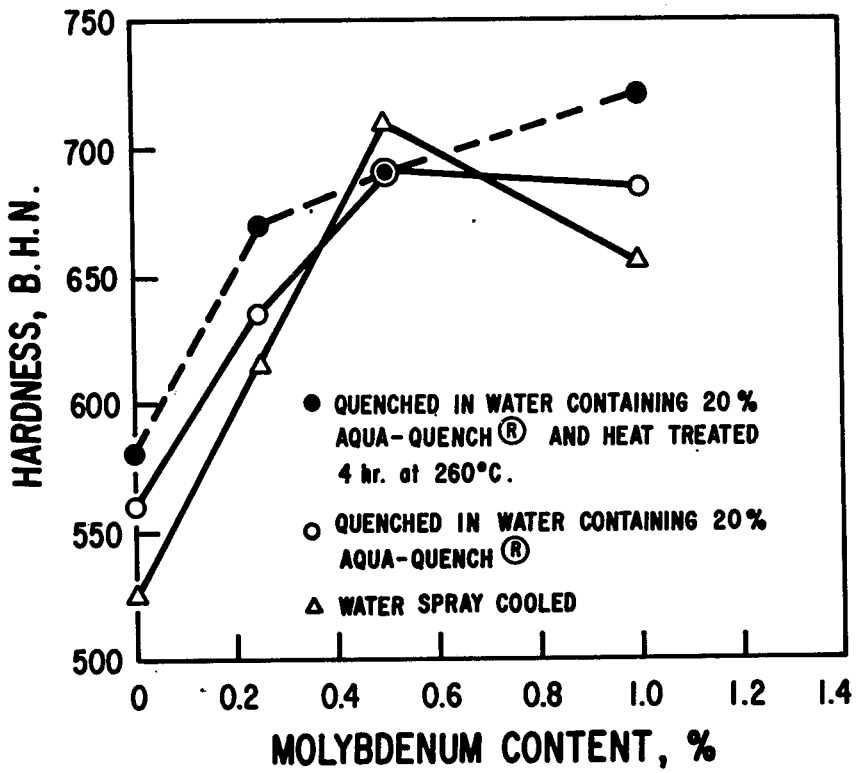

This is a continuation of application Ser. No. 747,105, filed Dec. 3, 1976, now abandoned.

This invention relates to a low alloy white cast iron having high hardness and superior wear resistance.

In certain applications, such as ore grinding balls or slugs, performance is primarily determined by microstructure. White cast irons contain several phases (austenite, carbide, pearlite, bainite, and martensite) the relative amounts of which determine their overall hardness and toughness. The amount of each phase present in these materials is controlled by composition, cooling rate from the pouring temperature to room temperature and by heat treatment. In order to have a high overall hardness, substantial amounts of martensite and carbide must be present in the microstructure. These phases can be produced by proper alloying tailored to a given set of processing variables.

White cast irons previously used for grinding media were either unalloyed or alloyed with chromium alone or with combinations of nickel and chromium. However, these white cast irons suffered from a number of drawbacks. Unalloyed white cast irons and those containing chromium had a low hardness and therefore a poor wear resistance. White cast irons containing nickel and chromium had a superior wear resistance but were expensive to use due to the cost of the alloying constituents.

A low alloy white cast iron having high hardness and superior wear resistance has been disclosed in applicant's Canadian Pat. No. 786,270 issued May 28, 1968 and in an article published by J. C. T. Farge, P. Chollet and J. Yernaux in the Foundry Trade Journal, Apr. 15, 1971, and entitled "Effect of Composition, Cooling-rate and Heat Treatment on Properties of a new Wear-resistant White Iron". The alloying elements disclosed in the alloy were manganese, carbon, silicon, copper and molybdenum. In Canadian Pat. No. 786,270, manganese was disclosed as being in the range of 1.5 to 16%, preferably between 2.5 and 5%, carbon in the range of 2 to 4%, silicon in the range of 0 to 2%, copper in the range of 0 to 2.5% and molybdenum in the range of 0 to 1% with the total amount of copper plus molybdenum not less than 0.1%. In the above article, the combined effect of alloy content, cooling rate from different shake-out temperatures, and heat treatment on the hardness and microstructure of sand-cast ore grinding balls containing about 3.2% carbon and 0.5% silicon was investigated over the range of 0.75 to 4.7% magnanese, with a copper content of 0.5 and 1%, and a molybdenum content of 0.2%.

A serious problem was encountered during the production of grinding media having the composition described in Canadian Pat. No. 786,270. White cast irons containing manganese in excess of 1.5% have a tendency, when in the molten state, to attack acid refractories normally used in melting furnaces such as cupolas. Also, attempts to produce grinding balls on an industrial scale according to the procedure described in the above mentioned article were not completely successful, primarily because of the low molybdenum content of the alloy. The microstructure of the grinding balls contained substantial amounts of pearlite which resulted in low overall hardness. It was therefore necessary to develop a white cast iron which could be produced with no difficulties and which would display high hardness and superior wear resistance.

It has been found, in accordance with the present invention, that optimum hardness and superior wear resistance can be obtained with an alloy containing essentially of 2 to 4% carbon, 0.3 to 1.5% silicon, 0.5 to 1.5% manganese, 0.5 to 1.5% copper and 0.25 to 1% molybdenum, the rest being iron except for incidental impurities normally found in cast iron. The preferred alloy composition consists essentially of about 2.5 to 3% carbon, 0.6 to 0.9% silicon, about 1% manganese, about 1% copper and about 0.5% molybdenum, the rest being substantially iron and having a microstructure consisting primarily of carbide and martensite.

The process for manufacturing the above wear resistant low alloy white cast iron comprises the steps of melting the above alloy in a suitable furnace such as a cupola or an electric furnace, casting the alloy into moulds to produce a desired product, such as grinding balls or slugs, shaking the product out of the moulds at a temperature of 750° C. or higher, preferably about 900° C., and cooling the article at a rate of 2° to 15° C./sec., preferably 5° to 10° C./sec. The various cooling media may be water, quenching oils and aqueous solutions of quenchants such as the one identified by the Trade Mark "Aqua-Quench".

The product is preferably heat treated at a temperature of 200° to 400° C., preferably about 260° C. for a time period of 1 to 8 hours, preferably 4 hours to increase the hardness thereof.

Optimum hardness was obtained in water spray cooled slugs containing 3% carbon, 0.9% silicon, 1% manganese, 1% copper and 0.5% molybdenum having a microstructure consisting primarily of carbide and martensite.

An example of the procedure followed will now be disclosed with reference to FIG. 1 which shows the relationship of alloy hardness versus percentage of molybdenum.

A number of experiments were carried out to investigate the effect of variations in carbon, silicon, manganese, copper and molybdenum. These experiments were made to establish the operating range for each addition element. The following alloys were prepared and cast into 1½-in. slugs:

(1) White cast iron nominally containing 0.9% Si+1% Mn+1% Cu+0.5% Mo and either 2.0, 2.5, 3.0, 3.5, or 4.0% C.

(2) White cast iron nominally containing 3% C+1% Mn+1% Cu+0.5% Mo and either 0.3, 0.6, 0.9, 1.2 or 1.5% Si.

(3) White cast iron nominally containing 3% C+0.9% Si+1% Cu+0.5% Mo and either 0.5, 1.0 or 1.5% Mn.

(4) White cast iron nominally containing 3% C+0.9% Si+1% MN+0.5% Mo and either 0.5, 1.0 or 1.5% Cu.

(5) White cast iron nominally containing 3% C+0.9% Si+1% Mn+1% Cu and either 0, 0.25, 0.5 or 1.0% Mo.

Alloy charges consisted typically of the following components:

Pig iron, steel scrap, ferro-manganese, ferro-silicon, ferro-molybdenum and copper scrap. The various materials were melted in a coreless induction furnace equipped with an alumina crucible. The molten metal was deslagged and poured into a preheated, movable clay graphite tundish located above a casting stand. The casting stand comprised cast iron moulds each containing a number of 1½-in. slug cavities and two cooling tanks one for water spraying and one for liquid quenching. The molten metal was poured into the tundish, and flowed into the moulds through suitable orifices. The moulds were preheated to 120° C. and were coated with graphite. The slugs were shaken out of the moulds at about 900° C. and were either water spray cooled or quenched in water containing 20% Aqua-Quench®. The corresponding cooling rates were established using thermocouples inserted into slug cavities while the metal was still molten and connected to a recording instrument. Recording of the temperature was started from the time of shake-out (900° C.) and continued until the slug temperature reached 150° C. It was found that the rate of cooling varied from 5° to 10° C./sec. depending on the cooling medium. The as-cast slugs were then subjected to a heat treatment of 4 hours at 260° C. The hardness and the microstructure of the as-cast and heat treated slugs are given in the following Tables I and II.

TABLE I

PROPERTIES OF 1½-in. CAST IRON GRINDING SLUGS CONTAINING % Mn + 1% Cu + 0.5% Mo

| Nominal Composition % | | Type of Cooling* | As-Cast 4h at 260° C. | | Heat treated for | |
|---|---|---|---|---|---|---|
| C | Si | | Hardness B.H.N. | Microstructure** | Hardness B.H.N. | Micro-structure** |
| 2.0 | 0.9 | s.c. | 495 | RA + M + C | 570 | M* + C |
| | | a.q. | 460 | RA + M + C | 555 | M* + C |
| 2.5 | 0.9 | s.c. | 705 | M + C + RA | 690 | M* + C |
| | | a.q. | 705 | M + C + RA | 670 | M* + C |
| 3.0 | 0.9 | s.c. | 710 | C + M + RA | 700 | C + M* |
| | | a.q. | 690 | C + M + RA | 690 | C + M* |
| 3.5 | 0.9 | s.c. | 655 | C + M + RA + G | 635 | C + M* + G |
| | | a.q. | 655 | C + M + RA + G | 615 | C + M* + G |
| 4.0 | 0.9 | s.c. | 670 | C + M + RA + G | 655 | C + M* + G |
| | | a.q. | 595 | C + M + RA + G | 635 | C + M* + G |
| 3.0 | 0.3 | s.c. | 655 | C + M + RA | 705 | C + M* |
| | | a.q. | 635 | C + M + RA | 705 | C + M* |
| 3.0 | 0.6 | s.c. | 690 | C + M + RA | 705 | C + M* |
| | | a.q. | 635 | C + M + RA | 690 | C + M* |
| 3.0 | 1.2 | s.c. | 670 | C + M + RA + (G) | 690 | C + M* + (G) |
| | | a.q. | 720 | C + M + RA + (G) | 705 | C + M* + (G) |
| 3.0 | 1.5 | s.c. | 535 | M + G + C + RA | 445 | M* + G + C |
| | | a.q. | 560 | C + M + RA + G | 495 | C + M* + G |

*s.c. Water spray cooled
a.q. Quenched in water containing 20% Aqua-Quench®
**M Martensite
C Carbide
RA Retained Austenite
M* Complex phase consisting of tempered martensite, retained austenite, bainite and fresh martensite
G Graphite
( ) Traces

TABLE II

PROPERTIES OF 1½-in. WHITE CAST IRON GRINDING SLUGS CONTAINING 3% C + 0.9% Si

| Nominal Composition % | | | Type of Cooling | As-Cast | | Heat Treated for 4h. at 260° C. | |
|---|---|---|---|---|---|---|---|
| Mn | Mo | Cu | | Hardness B.H.N. | Microstructure** | Hardness B.H.N. | Micro-Structure** |
| 0.5 | 0.5 | 1.0 | s.c. | 655 | C + M + RA + (P) | 670 | C + M* + (P) |
| | | | a.q. | 705 | C + M + RA | 705 | C + M* |
| 1.0 | 0.5 | 1.0 | s.c. | 710 | C + M + RA | 700 | C + M* |
| | | | a.q. | 690 | C + M + RA | 690 | C + M* |
| 1.5 | 0.5 | 1.0 | s.c. | 685 | C + M + RA | 690 | C + M* |
| | | | a.q. | 670 | C + M + RA | 690 | C + M* |
| 1.0 | 0.5 | 0.5 | a.q. | 655 | C + M + RA + (P) | 670 | C + M + (P) |
| 1.0 | 0.5 | 1.5 | s.c. | 685 | C + M + RA | 710 | C + M* |
| | | | a.q. | 655 | C + M + RA | 670 | C + M* |
| 1.0 | 0.25 | 1.0 | s.c. | 615 | C + M + RA + P | 635 | C + M* + P |
| | | | a.q. | 635 | C + M + RA + P | 670 | C + M* + P |
| 1.0 | 1.0 | 1.0 | s.c. | 655 | C + M + RA | 710 | C + M* |
| | | | a.q. | 685 | C + M + RA | 720 | C + M* |

*s.c. Water spray cooled
a.q. Quenched in water containing 20% Aqua-Quench®
**M Martensite
C Carbide
RA Retained Austenite
M* Complex phase consisting of tempered martensite, retained austenite, bainite and fresh martensite
( ) Traces
P Pearlite The following observations can be made from these results:

(1) The risk of graphite flakes formation in white cast iron containing 0.9% silicon increases as the carbon content increases beyond 3%. The overall hardness of cast iron normally decreases as the amount of graphite flakes increases.

(2) The risk of graphite flakes formation in white cast iron containing 3% carbon+1% manganese+1% copper and 0.5% molybdenum increases as the silicon content increases beyond 0.9%. It has generally been recognized that silicon contents of less than 0.6% adversely affect the fluidity of molten iron, while the present results show that silicon contents higher than 0.9% increase the tendency for graphite flakes formation. Thus the silicon content of the new alloy should preferably fall within the limits of 0.6 to 0.9%.

(3) Traces of pearlite are present in white case iron containing 3% carbon+0.9% silicon+1% copper+0.5% molybdenum and 0.5% manganese. This indicates that more than 0.5% manganese must be present in order to avoid pearlite formation. On the other hand, manganese contents greater than 1.5% are detrimental to furnace refractories.

(4) Traces of pearlite are present in white cast iron containing 3% carbon+0.9% silicon+1% manganese+0.5% molybdenum and 0.5% copper. This indicates that more than 0.5% copper must be present in order to avoid pearlite formation. With 1% copper, no pearlite is present in the microstructure. A further increase from 1.0 to 1.5% copper did not result in additional hardness improvement.

(5) Increasing the molybdenum content from 0.25 to 0.5% significantly increases the hardness of white cast iron containing 3% carbon+0.9% silicon+1% manganese+1% copper. FIG. 1 illustrates the effect of increasing the molybdenum content on the hardness of the alloy. It can be seen that increasing the molybdenum content from 0.25 to 0.5% increases the hardness from 615 B.H.N. to 710 B.H.N. when the slugs are water spray cooled and from 635 to 690 B.H.N. when the slugs are quenched in water containing 20% Aqua-Quench ®. Increasing the molybdenum content from 0.5 to 1% lowers the hardness of the water spray cooled slugs and does not significantly affect the hardness of the slugs quenched in water containing 20% Aqua-Quench ®. It does however increase the hardness of the slugs which were subsequently heat treated.

On the basis of the above considerations, it is clear that the optimum alloy composition to avoid the formation of graphite flakes and to obtain a high hardness and a microstructure primarily consisting of carbide and martensite should be as follows:

2.5 to 3% carbon
0.6 to 0.9% silicon
1% manganese
1% copper
0.5% molybdenum

Full scale foundry tests have shown that the new white cast iron of the present invention may be melted and cast using ordinary foundry practice and casting methods. The melting equipment used so far in these full scale tests has been a channel-type induction furnace. However, other melting equipment such as cupolas or various types of electric furnaces could also be used. Tests to date have been made on 1½-inch grinding balls cast in permanent moulds. Sand casting could also be used provided that the products are shaken out of the mould at a temperature of 750° C. or higher.

Laboratory wear tests and ore grinding field tests were carried out on 1½-inch diameter grinding balls cast from the preferred alloy are subjected to the preferred processing schedule. The results are given in Table III.

TABLE

RESULTS OF WEAR RESISTANCE TESTS

| Material | Size and Shape of Grinding media | Laboratory Test* Weight loss, mg | Field tests** Consumption lb/ton of ore |
|---|---|---|---|
| New white cast iron | 1½-in. diameter balls | 59.9 | 2.13 |
| Forged steel | 1½-in. diameter balls | 63.2 | 2.38 |
| White cast iron containing 1.8% Cr | 1½-in. slugs | 73.5 | 3.18 |

*Pin Test: A cylindrical pin (0.25-in. diameter X 1-in. long) is machinedfrom the grinding media to be tested. The pin moves back and forth in anonoverlapping pattern across a fresh abrasive cloth of 180-mesh aluminawhile under a load of 15 lb. As it travels, it also rotates around itsaxis at 20 rpm. After 7 minutes the test is stopped and the weight lossof the pin is determined.
**Tests conducted in industrial size ball mills for several months.

It can be seen that the new white cast iron displays a better wear resistance than chromium-bearing white cast iron and forged steel grinding media. At the present time, forged steel is the most widely used material for ore grinding in North America and its wear resistance is equivalent to that of white cast irons containing nickel and chromium.

Although the invention has been disclosed with reference to a preferred example, it is to be understood that other alloy compositions are also envisaged within the broad range disclosed and that the various steps for making the alloy including the cooling rates from various shake-out temperatures and the temperature of the heat treatment may be varied within the limits defined in the accompanying claims.

The embodiments of the invention in which an exclusive property or privilege is claimed are defined as follows:

1. A wear resistant low alloy white cast iron consisting of from about 2 to 4% carbon, from about 0.3 to 1.2% silicon, from about 0.5 to 1.5% manganese, from about 0.5 to 1.5% copper and from about 0.25 to 1% molybdenum, the remainder being substantially all iron except for incidental impurities commonly found in cast iron, said alloy having a microstructure consisting essentially of carbide and martensite.

2. A wear resistant low alloy white cast iron as defined in claim 1, wherein the composition is between 2.5 and 3% carbon, 0.6 and 0.9% silicon, about 1% manganese, about 1% copper and about 0.5% molybdenum.

3. A wear resistant low alloy white cast iron as defined in claim 1 wherein the composition is from about 2 to 4% carbon, from about 0.3 to 0.9% silicon, from about 0.5 to 1% manganese, from about 0.5 to 1.5% copper and from about 0.25 to 1% molybdenum.

4. A wear resistant low alloy white cast iron as defined in claim 1 wherein the composition is from about 2 to 4% carbon, from about 0.3 to 1.2% silicon, from about 0.5 to 1% manganese, from about 0.5 to 1.5% copper and from about 0.25 to 1% molybdenum.

5. A wear resistant low alloy white cast iron as defined in claim 1 wherein the compositon is from about 2 to 4% carbon, from about 0.3 to 1.2% silicon, about 1% manganese, from about 0.5 to 1.5% copper and from about 0.25 to 1% molybdenum.

6. The wear resistant low alloy white cast iron as defined in claim 1 in which the alloy has a minimum hardness of 445 B.H.N.

* * * * *